US011447951B2

(12) United States Patent
Monier

(10) Patent No.: US 11,447,951 B2
(45) Date of Patent: Sep. 20, 2022

(54) CEILING TILE WITH INTEGRATED BAFFLE

(71) Applicant: FACT Design, LLC, Davis, CA (US)

(72) Inventor: Daniel Monier, Atlanta, GA (US)

(73) Assignee: FACT Design, LLC, Davis, CA (US)

( * ) Notice: Subject to any disclaimer, the term of this patent is extended or adjusted under 35 U.S.C. 154(b) by 0 days.

(21) Appl. No.: 17/181,340

(22) Filed: Feb. 22, 2021

(65) Prior Publication Data

US 2022/0154462 A1 May 19, 2022

Related U.S. Application Data

(63) Continuation-in-part of application No. 16/952,535, filed on Nov. 19, 2020, now Pat. No. 10,975,568.

(60) Provisional application No. 63/143,378, filed on Jan. 29, 2021.

(51) Int. Cl.

| | |
|---|---|
| ***E04B 9/00*** | (2006.01) |
| ***E04B 9/04*** | (2006.01) |
| ***E04B 9/24*** | (2006.01) |

(52) U.S. Cl.

CPC ..... *E04B 9/0414* (2013.01); *E04B 9/241* (2013.01)

(58) Field of Classification Search

CPC ..... E04B 1/99; E04B 1/001; E04B 1/8227; E04B 1/84; E04B 1/8409; E04B 9/0414; E04B 9/00; E04B 9/225; E04B 9/04; G10K 11/62

USPC ..... 52/144, 220.1, 220.6, 220.8, 506.01

See application file for complete search history.

(56) References Cited

U.S. PATENT DOCUMENTS

| | | | | |
|---|---|---|---|---|
| 1,845,080 | A | 2/1932 | Eyring et al. | |
| 2,882,990 | A | 4/1959 | Mustoe | |
| 3,321,877 | A | 5/1967 | Alexieff | |
| 3,343,309 | A | 9/1967 | Norman et al. | |
| 3,404,498 | A | 10/1968 | Espinoza | |
| 3,466,830 | A | 9/1969 | Smith | |
| 3,548,735 | A | 12/1970 | Sweeney et al. | |
| 3,685,235 | A | 8/1972 | Lang | |
| 3,835,614 | A | 9/1974 | Downing | |
| 3,969,870 | A * | 7/1976 | Deaton | F21V 11/06 52/645 |

(Continued)

FOREIGN PATENT DOCUMENTS

| | | | |
|---|---|---|---|
| FR | 3088352 | A1 | 5/2020 |
| WO | 2020095163 | A1 | 5/2020 |

OTHER PUBLICATIONS

Sullivan, C. C., & Horwitz-Bennett, B. (Feb. 2013). "New Trends in Ceiling Designs and Materials." Ceiling Systems AIA Continuing Education.

*Primary Examiner* — Brian E Glessner
*Assistant Examiner* — James J Buckle, Jr.
(74) *Attorney, Agent, or Firm* — United IP Counselors, LLC

(57) ABSTRACT

Ceiling tiles for drop ceilings are disclosed. The ceiling tiles have a main portion that is comprised of a sheet of material, such as tile material, and a baffle portion. The main portion has an enclosed slot, and the baffle portion inserts into the slot such that with the ceiling tile in an installed orientation, the baffle portion extends downwardly from the main portion. The baffle portion has a flange on one end that is larger than the slot in at least one of width or length, such that the flange retains the baffle portion in the slot. Drop ceilings that use these ceiling tiles are also disclosed.

20 Claims, 9 Drawing Sheets

(56) References Cited

U.S. PATENT DOCUMENTS

| | | | | |
|---|---|---|---|---|
| 4,330,046 | A | 5/1982 | Lerner et al. | |
| 4,665,674 | A * | 5/1987 | Brugman | E04B 9/127 52/506.06 |
| 4,672,780 | A | 6/1987 | Lockwood | |
| 4,776,139 | A | 10/1988 | Lockwood | |
| D373,831 | S | 9/1996 | Lechleiter et al. | |
| 6,467,209 | B1 | 10/2002 | Vickers | |
| 6,622,579 | B1 | 9/2003 | Muth et al. | |
| 8,327,591 | B2 | 12/2012 | Wilkinson, Jr. et al. | |
| 8,733,053 | B2 * | 5/2014 | Kabatsi | E04C 1/40 52/506.07 |
| 8,782,987 | B2 | 7/2014 | Kabatsi et al. | |
| 9,038,326 | B2 | 5/2015 | Bergman et al. | |
| 9,487,952 | B2 | 11/2016 | Nilsson et al. | |
| 9,765,519 | B2 | 9/2017 | Bergman | |
| 10,006,619 | B1 | 6/2018 | Niemiec et al. | |
| 10,359,163 | B1 | 7/2019 | Hettwer et al. | |
| 10,508,444 | B2 | 12/2019 | Gillette et al. | |
| 10,584,488 | B2 | 3/2020 | Gillette et al. | |
| 10,662,647 | B2 | 5/2020 | Kilian et al. | |
| 10,928,020 | B1 | 2/2021 | Ahmadi et al. | |
| 2006/0016145 | A1 | 1/2006 | Lonneman | |
| 2011/0146183 | A1 | 6/2011 | Wilkens et al. | |
| 2014/0157689 | A1 | 6/2014 | Bergman et al. | |
| 2015/0068135 | A1 * | 3/2015 | Waters | E04B 9/00 52/39 |
| 2018/0180052 | A1 | 6/2018 | Niemiec et al. | |
| 2018/0245344 | A1 * | 8/2018 | Venjen-Jensen | E04B 9/363 |
| 2018/0363295 | A1 * | 12/2018 | Gillette | E04B 9/248 |
| 2019/0113219 | A1 | 4/2019 | Niemiec et al. | |
| 2020/0002942 | A1 | 1/2020 | Headley et al. | |

* cited by examiner

CEILING TILE WITH INTEGRATED BAFFLE

CROSS-REFERENCE TO RELATED APPLICATIONS

This application is a continuation-in-part of U.S. application Ser. No. 16/952,535, filed Nov. 19, 2020, and also claims priority to U.S. Provisional Patent Application No. 63/143,378, filed Jan. 29, 2021. The contents of both of those applications are incorporated by reference herein in their entirety.

TECHNICAL FIELD

The invention relates to a ceiling tile with an integrated vertical baffle.

BACKGROUND

The drop ceiling has been ubiquitous in commercial and some residential buildings for decades. In a drop ceiling, a grid is installed at a height below the actual ceiling height of the building or floor. Tiles of standard sizes are dropped into the grid. Lighting fixtures, speakers, air returns, and other standard ceiling elements may also be placed in the grid. The parts of a drop ceiling are simple, easily installed, and easily removed and replaced if, for example, a tile is damaged or it becomes necessary to access the ductwork above.

Properly installed, a drop ceiling shields ductwork, wiring, and other building mechanics from view. It also reduces sound and distracting or productivity-reducing noise from the space below it by absorbing, scattering, or otherwise attenuating sound waves.

As useful as they are, drop ceilings do have drawbacks. In many cases, they are not completely effective at noise reduction. They are sometimes seen as architecturally mundane. Over the years, architects, interior designers, and others have sought to create more expansive spaces by omitting drop-ceilings. This trend cuts across industries to encompass office space, retail space, schools, and even residences. Related developments, like the so-called "open office" concept, eschew private offices in favor of large, open areas in which many people work collaboratively. This has created a demand for sweeping, expansive spaces without drop ceilings. Unfortunately, noise persists.

To control noise in spaces without drop ceilings, architects and designers often create custom baffles that hang down from the actual ceiling. While these can be effective, they usually use custom support beams and mounting hardware and are much more difficult for contractors to install and maintain. Moreover, custom baffles often do not have all of the advantages of a drop ceiling.

BRIEF SUMMARY

One aspect of the invention relates to a ceiling tile for a drop ceiling. The ceiling tile has a main portion that is sized and adapted to fit within a grid of the drop ceiling, and a baffle that hangs down from the main portion. Thus, installed in a drop ceiling, the ceiling tile may be able to offer both the advantages of a drop ceiling and the additional advantages of having a baffle.

The ceiling tile may be arranged such that it can be made, shipped, and sold in a flat configuration and folded into a three-dimensional configuration with the down-hanging baffle for installation. For example, the ceiling tile may comprise a flat sheet of tile material with a particular length, width, and thickness. The sheet of tile material may have a plurality of fold lines defined in it that allow the sheet to fold in such a way as to define a main portion and the baffle. The dimensions of the sheet of tile may be such that it has a standard size, e.g., two-foot by four-foot, in manufacture and shipping, but folds such that the main portion has a smaller standard size, e.g., two-foot by two-foot, for installation.

The proportions of the sheet of tile material and the locations of fold lines may be chosen so that the baffle has a variety of different configurations. For example, in one embodiment, the baffle may hang vertically down and may comprise two abutted thicknesses of tile material. In another embodiment, two sections of tile material may hang down at mirror-image angles, forming a triangular baffle. A single ceiling tile may have more than one baffle. For example, a single ceiling tile may have two V-shaped baffles that are staggered in position along the tile.

In a ceiling tile according to another aspect of the invention, the tile comprises a main portion and a baffle portion. The main portion includes a slot, and the baffle portion inserts into the slot to extend downwardly from the main portion. The baffle portion has a flange at one end. The flange is larger than the slot in at least one dimension, such that the flange retains the baffle portion in the slot. In many cases, the main portion will extend horizontally within the suspended grid of a drop ceiling, while the baffle will extend vertically.

Yet another aspect of the invention relates to a drop ceiling. The drop ceiling includes a suspended grid and a plurality of tiles sized and adapted to fit within the grid. At least some of the plurality of tiles have a baffle or baffle portion as described above.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the description, and in which.

DETAILED DESCRIPTION

Figure 1:
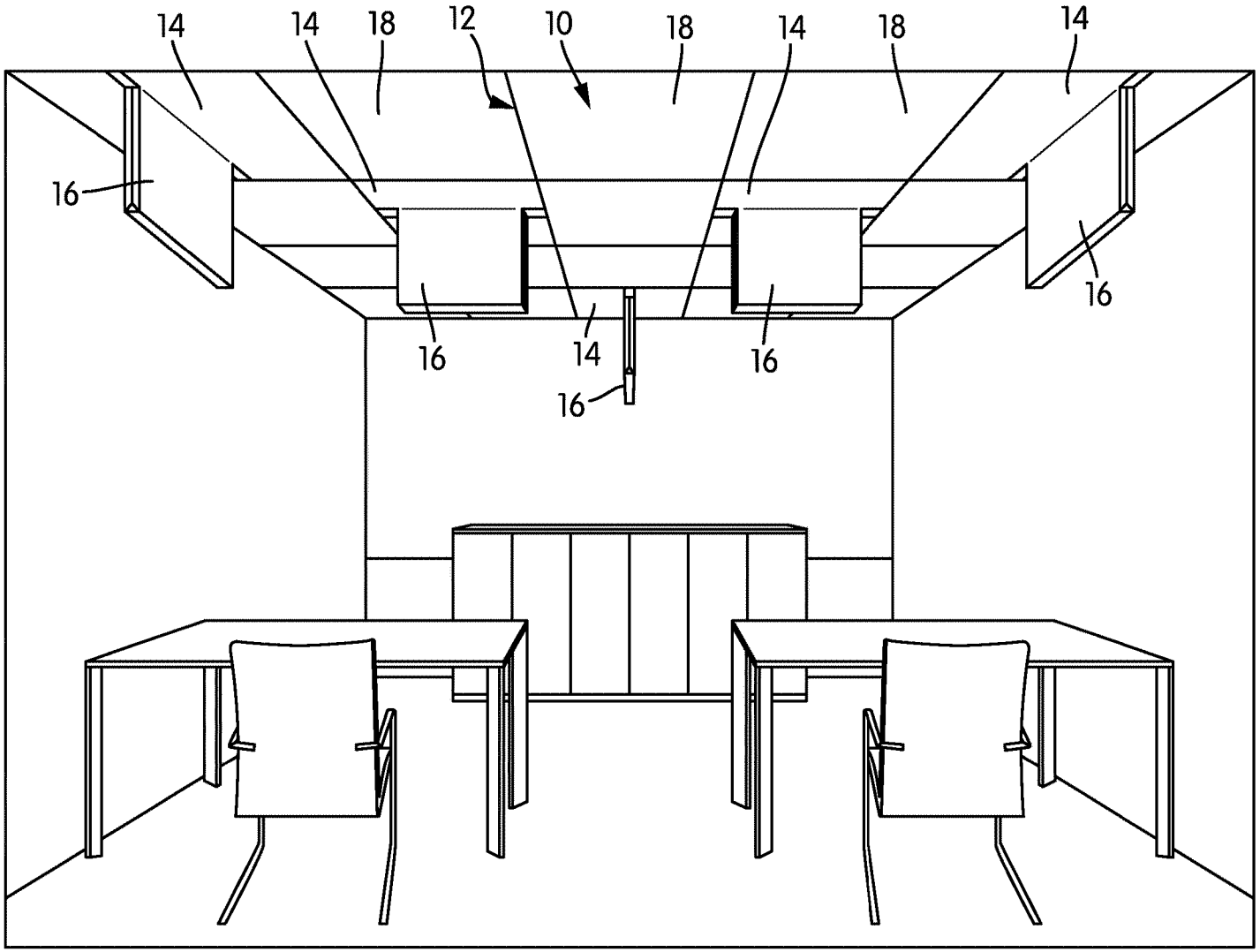
FIG. 1 is a perspective view of a drop ceiling in an office setting, illustrating drop ceiling tiles with vertically-extending baffles.

FIG. 1 is a perspective view of drop ceiling, generally indicated at 10, shown as the functional ceiling in a building.

A drop ceiling 10 according to an embodiment of the invention may be installed in office spaces, residential spaces, retail spaces, schools, hospitals, and in any other type of building or space where a drop ceiling might be used, although for convenience, some portions of this description may refer to office spaces.

The drop ceiling 10 includes a grid 12 that is suspended from the actual ceiling of the floor or building in a conventional manner. Installed in the grid 12 are a number of tiles 14 that include vertical baffles 16. For ease of illustration and to aid in understanding, five baffle-tiles 14 are shown in the view of FIG. 1; however, in many installations, every tile in the grid 12 may be a baffle-tile 14.

In many ways, the drop ceiling 10 has the same or similar features as most drop ceilings, such that it is routine to install and easy to maintain for the same reasons as a conventional drop ceiling. The baffle-tiles 14 can serve as direct replacements for conventional ceiling tiles 18. However, the individual baffles 16, and all of the baffles 16 collectively, may have more benefit than a traditional drop ceiling with traditional, flat ceiling tiles in controlling noise. This may be especially true in an open-environment floorplan when there are few or no cubicles or other barriers between workstations or other areas at the floor level. As those of skill in the art will appreciate, the arrangement shown in FIG. 1 is exemplary; the arrangement of baffle-tiles 14 and the presence or absence of conventional tiles 18 in any particular installation will depend on the layout of the building or floor, the type and arrangement of workstations, and other conventional factors.

While the illustration of the drop ceiling 10 of FIG. 1 is simple and generic for ease of explanation, the drop ceiling 10 of FIG. 1 may have any configuration that a conventional drop ceiling may have. Additionally, while the drop ceiling 10 has a number of general benefits that may apply wherever it is installed, it may also confer specific benefits in particular types of settings. For example, a drop ceiling 10 installed in a hospital setting may reduce the level of noise that is carried from one area to another, making it easier for medical staff to have private conversations, even in public or semi-public areas, without risk that protected patient health information will be overheard. In universities and schools, a drop ceiling 10 may cut down on noise and distractions, increase concentration, and indirectly improve academic performance, especially for students seated farthest from the front of the room.

Over the decades that drop ceilings have been in use, ceiling tiles have been made of a variety of materials. In most modern installations, ceiling tiles are made of a polyethylene terephthalate (PET) felt, typically with at least some recycled content. Baffle-tiles 14 may be made with the same material, or with any other material that is commonly used to make ceiling tiles. References to "tile material" in this description should be construed to refer to any material of which an acoustic ceiling tile may be made, although many embodiments will be made of PET felt.

Baffle-tiles 14 may be manufactured, shipped, and sold in configurations like that shown in FIG. 1. However, doing so typically incurs greater inconvenience and cost in shipping and handling. For that reason, it is advantageous if baffle-tiles 14 are made such that they can be manufactured and shipped in a flat form and assembled into their final configuration at the time of installation.

Figure 2:
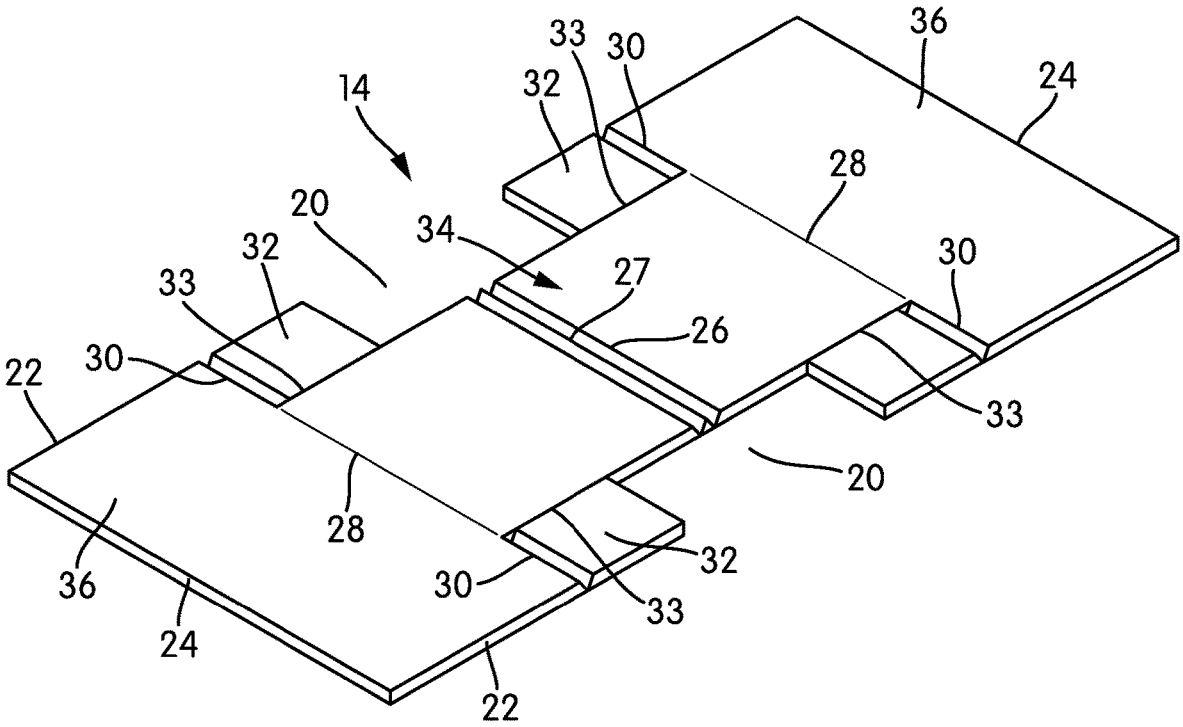
FIGS. 2-4 are perspective views illustrating the folding of a drop ceiling tile of FIG. 1 from a flat configuration into the three-dimensional configuration shown in FIG. 1.

FIG. 2 is a perspective view of a baffle-tile 14 in a flat configuration. The baffle-tile 14, when flat, has the overall size and proportions of a traditional two-foot by four-foot (0.6 by 1.2 m) ceiling tile. The baffle-tile 14 will generally also have the same flat thickness as a conventional ceiling tile, which is typically 9 mm (0.35 in). The baffle-tile 14 of the illustrated embodiment is made by creating fold lines in a traditional ceiling tile in such a way that it can be folded into the three-dimensional configuration shown in FIG. 1. The term "fold lines" is a general one that, for purposes of this description, means any sort of modification to the tile that allows it to fold along the defined line, including cuts (such as V-cuts) and scores. In some embodiments, it may be necessary or desirable to add a reinforcing member that acts as a hinge, and the term "fold lines" should be read broadly enough to encompass such reinforced hinging areas. This description also refers to "break lines," which are frangible score or cut lines that may be used to break sections of the baffle-tile 14 away. A break line may be a deeper cut or score than a fold line.

A rectangular area 20 of material has been removed from each long side 22 of the baffle-tile 14. The rectangular area 20 that has been removed is centered along each long side. Each rectangular area 20 extends approximately one-quarter of the length of the long side 22 and has a width approximately one-quarter of the width of the baffle-tile 14 (i.e., one-quarter the length of the short side 24). The removed rectangular areas 20 give the remaining area of the baffle-tile 14 a short "dog bone" shape. While the rectangular areas 20 are shown as fully removed in the view of FIG. 2, when the baffle-tile 14 is manufactured and shipped, the rectangular areas 20 may merely be scored or otherwise partially cut at break lines for break-out and removal at the time of installation.

A first fold line 26 extends straight across the midpoint of the long side 22 of the baffle-tile 14, coinciding with the transverse centerline of the baffle-tile 14. As shown in FIG. 2, the first fold line 26 actually comprises more than one cut; specifically, a pair of parallel V-cuts are spaced a very small distance from one another on opposite sides of the transverse centerline of the baffle-tile 14. This leaves a triangular piece of material 27 along the transverse centerline. Thus, although this description uses the term "fold line" in the singular, a single fold line may include multiple cuts or scores, as the first fold line 26 does.

As can be appreciated from FIG. 2, the baffle-tile 14 is symmetrical about the first fold line 26; one-half of the baffle-tile 14 is a mirror image of the other. A set of second fold lines 28 parallel to the first fold line 26 and spaced about one-quarter of the length of the baffle-tile 14 to each side of the first fold line 26 define the central portion 34 of the baffle-tile 14 that folds to become the baffle 16. Each of the second fold lines 28 comprises a single V-cut in the illustrated embodiment.

Additionally, a set of four tab fold lines 30 aligned in position with the second fold lines 28 and parallel with the first fold line 28 and the transverse centerline of the baffle-tile 14 define a set of four tabs 32. The tabs 32 border the rectangular area 20 that has been removed from the baffle-tile 14 in the configuration of FIG. 2. Short break lines 33 parallel to the long sides 22 of the baffle-tile 14 and its longitudinal centerline extend a short distance to separate the tabs 32 from the central portion 34 of the baffle-tile 14.

Figure 3:
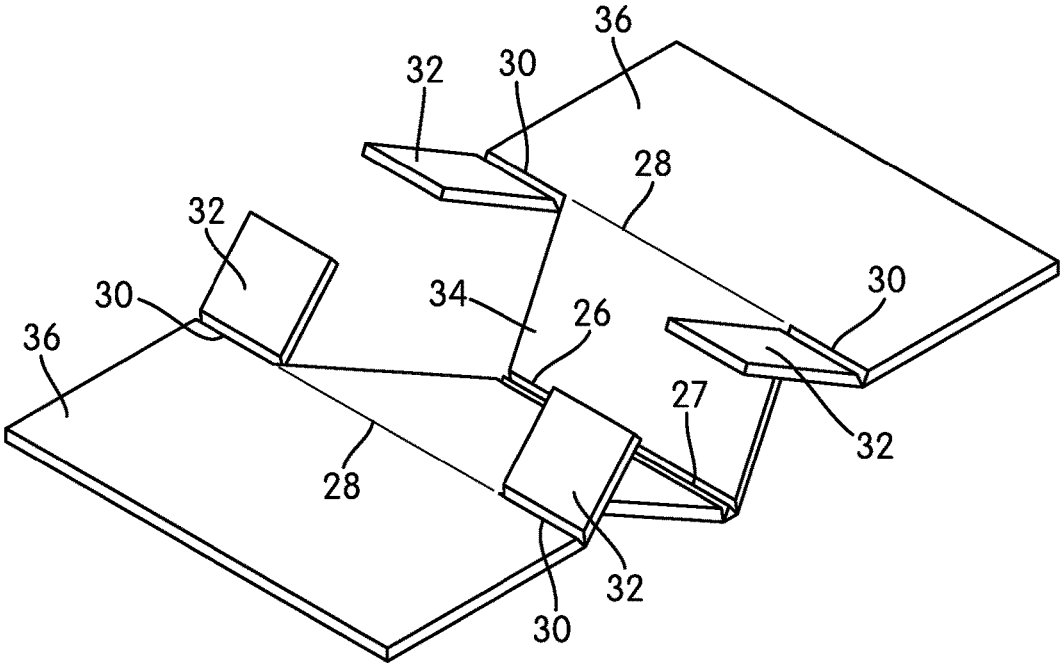
Figure 4:
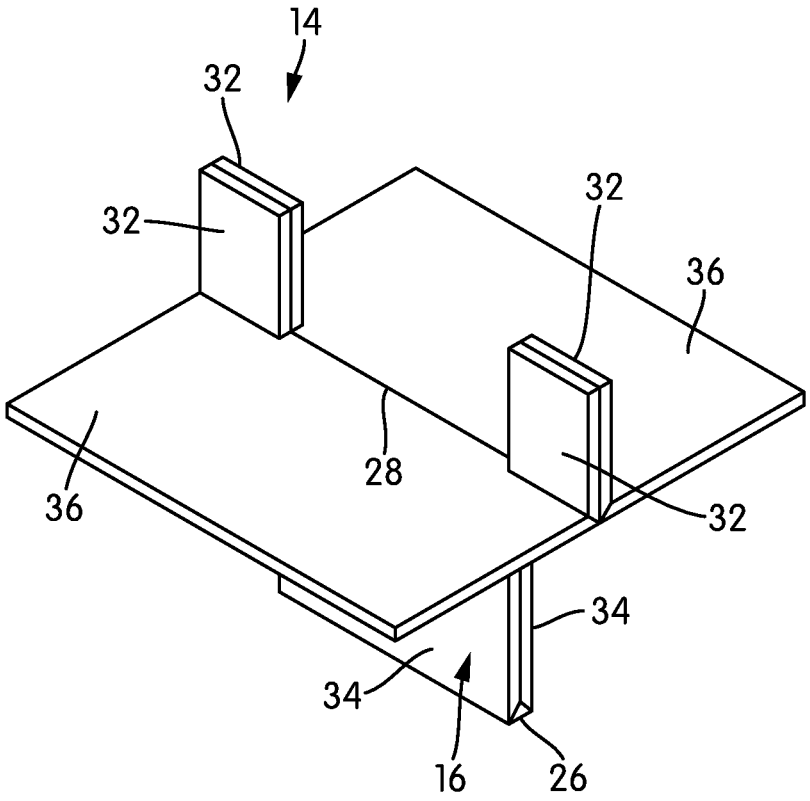

FIGS. 3 and 4 are perspective views that illustrate the folding sequence that transforms the baffle-tile 14 from the flat configuration shown in FIG. 2 to the fully folded configuration illustrated in FIG. 1. As shown in FIG. 3, the fold lines 26, 28 are configured so that the two sections of the central portion 34 fold down relative to the rest of the baffle-tile 14, such that in the position of FIG. 3, the two parts of the central portion 34 hinge relative to the first fold line 26, with the first fold line 26 acting much line the spine of a book when the book is closed. While this occurs, the two rectangular segments 36 on the opposite sides of the second fold lines 28 are drawn closer to one another.

As shown in FIG. 4, and as was described above, in the folded, three-dimensional configuration, the baffle 16 is constituted by the two sections of the central portion 34 folded against and abutting one another. The first fold line 26 and the other parts of the baffle-tile 10 are dimensioned and constructed to allow this abutment to occur. Thus, as a practical matter, the baffle 16 has a double thickness of tile material, which may aid its effectiveness in absorbing or dissipating noise. Meanwhile, the two end-segments 36 of the baffle-tile 14 are brought nearly into contact with one another, but-for the doubled thickness of the baffle 16 separating them. In this folded configuration, pairs of tabs 32 extend up, opposite and parallel to the downwardly-extending baffle 16. Pairs of tabs 32 opposite one another abut each other, as shown in FIG. 4. When installed, the tabs 32 would extend a short way up into the plenum space above the drop ceiling 10.

The elements of the baffle-tile 14 may be dimensioned and proportioned such that the baffle-tile 14 has a two-foot by four-foot area in the flat configuration of FIG. 2 and a two-foot by two-foot horizontal area in the folded configuration of FIGS. 1 and 4. These are both standard sizes for conventional drop-ceiling tiles 18. In other words, when unfolded, the baffle-tile 14 has a standard size which enables it to be handled and shipped in standard ways, and when folded, the baffle-tile 14 has another standard size that allows it to be installed in a standard grid. That said, there is no requirement that the baffle-tile 14 have any particular size in either configuration. In fact, there may be embodiments in which a grid of non-standard size is created specifically for baffle-tiles of that non-standard size.

Once a baffle-tile is installed in the grid 10, lateral forces exerted by the grid 10 itself may be sufficient to keep the baffle-tile 14 in its folded, operational configuration without more. However, if those forces are not sufficient to keep a baffle-tile 14 in its folded configuration, the tabs 32 that are opposite and abutting one another may be secured together with adhesive tabs or fasteners driven through the abutted pairs of tabs 32. Adhesive tabs may be pre-installed on the tabs 32 with release layers that can be pulled away to expose pressure-sensitive adhesive. That said, the installer is also free to use whatever fasteners are convenient including, e.g., drywall screws or nails.

The folded configuration of the baffle-tile 14 that is shown in FIG. 4 may have an additional advantage. The double thickness of the baffle 16 and the tabs 32 along the centerline of the baffle-tile 14 may, in effect, serve as a reinforcing beam that reduces any sagging that might otherwise occur.

The configuration of the baffle-tile 14 is but one of many possible configurations for a tile in accordance with embodiments of the invention. More complex and intricate folding schemes may be used. Additionally, the proportions of the baffle-tile 14 can be adjusted to create different effects. For example, the central section of a baffle-tile may have multiple fold lines to fold accordion-style for a thicker, albeit shorter, baffle.

Figure 5:
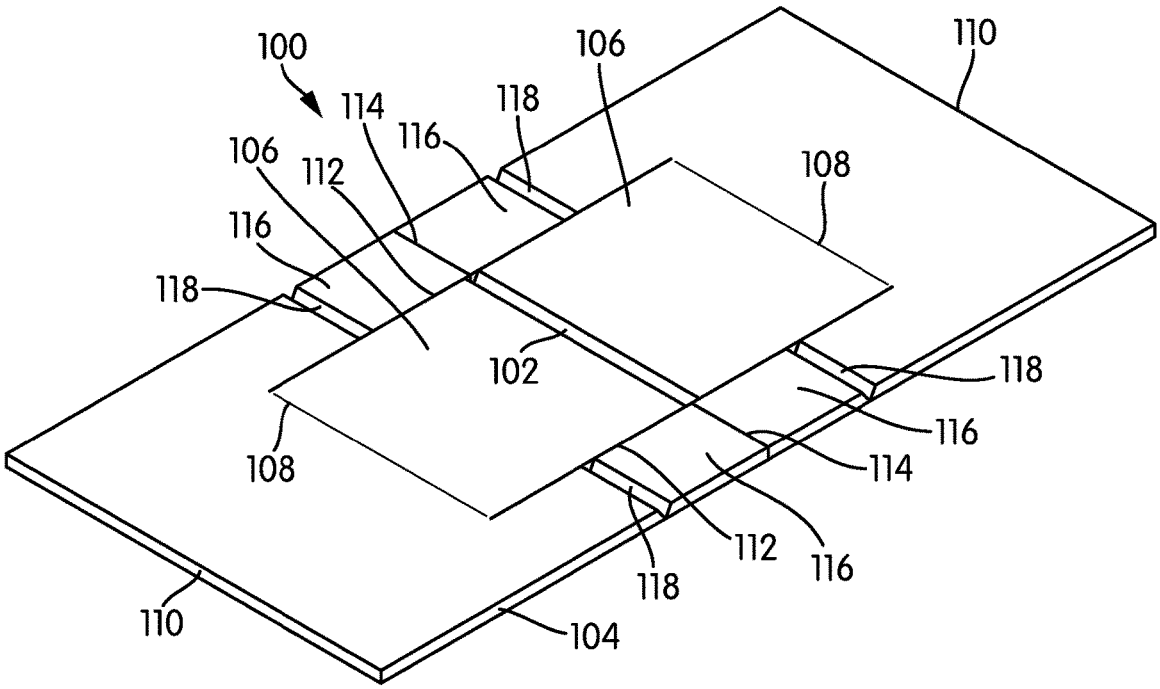
FIGS. 5-7 are perspective views of a baffle-tile according to another embodiment, illustrating the folding of the baffle-tile from a flat configuration into a three-dimensional configuration suitable for installation in a drop ceiling.
Figure 6:
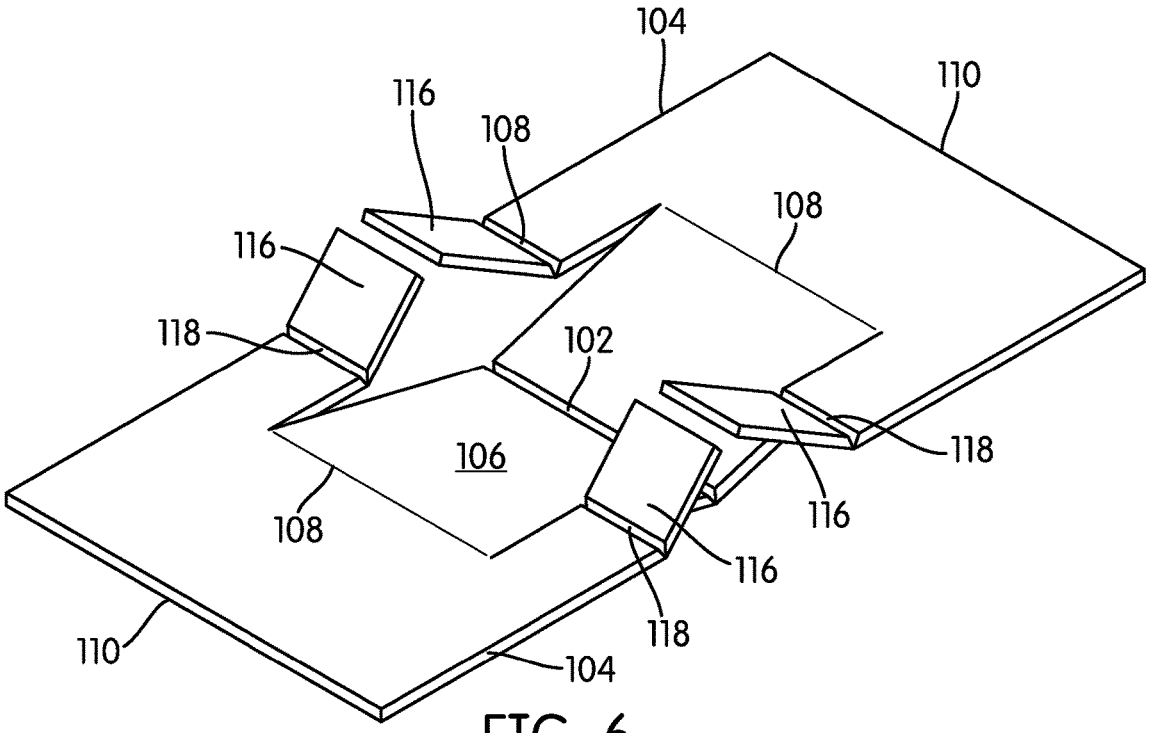
Figure 7:
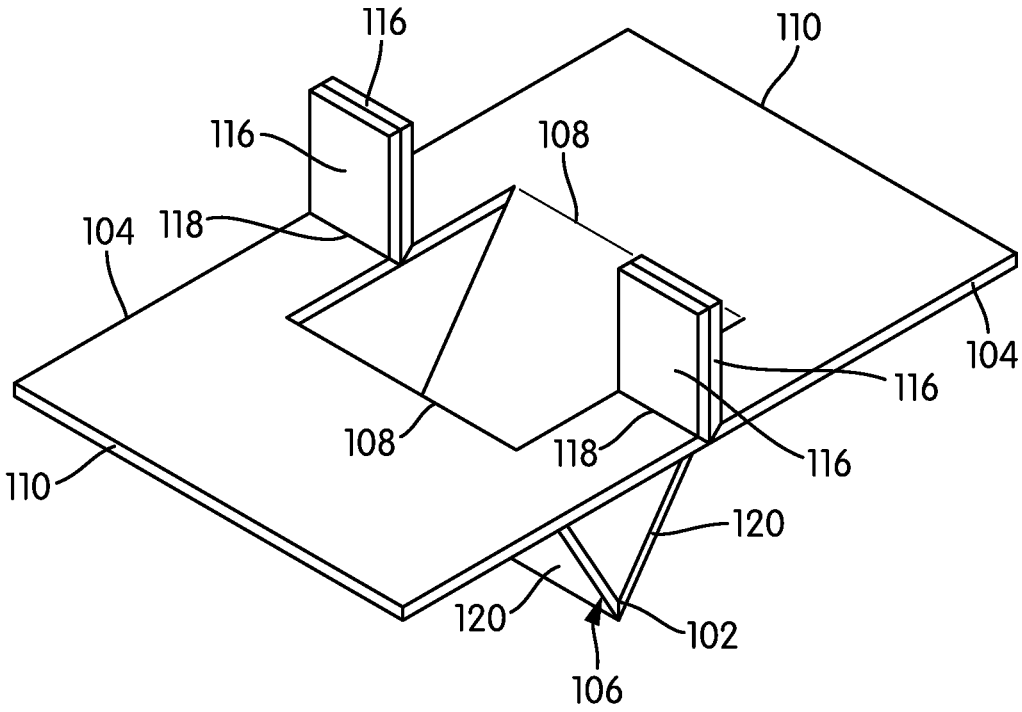

FIGS. 5-7 are perspective views illustrating a folding sequence for a baffle-tile 100 according to another embodiment of the invention. The baffle-tile 100 has the same two-foot by four-foot dimensions in its flat initial or shipping configuration as the baffle-tile 14 and standard tiles. A first fold line 102 is positioned at the center of the long side 104 of the baffle-tile 100 again coincident with the transverse centerline of the baffle-tile 100, creating a two-part central portion 106 that folds down to create a baffle. A set of second fold lines 108, spaced equidistantly and on either side of the first fold line 102, define the other ends of the central portion 106. The second fold lines 108 are positioned approximately half of the distance between the first fold line 102 and the short sides 110.

One of the main differences between the baffle-tile 100 of FIGS. 5-7 and the baffle-tile 14 described above is that in the baffle-tile 100, there are no rectangular areas 20 that are removed. The baffle-tile 100 thus has the entire area of a two-foot by four-foot tile. A pair of lateral break lines 112 separates the central area 106 from the sides of the baffle-tile 100. A pair of break lines 114 on either side of the central area 106 and aligned with the first fold line 102 define a pair of opposed tabs 116, one on each side of the centerline defined by the first fold line 102 and the two aligned break lines 114. Pairs of tab fold lines 118 are positioned on each side of the baffle-tile 100 toward the short sides 110, allowing the tabs 116 to fold relative to the rest of the baffle-tile 100.

FIG. 6 illustrates the first stages of folding the baffle-tile 100 into its three-dimensional configuration. The tabs 116 are broken apart at the break lines 114 and fold upwardly about the tab fold lines 118. Meanwhile, the central area 106 folds down, hinging about the second fold lines 108. The sense of the folding motion is similar to that described above with respect to the baffle-tile 14, but the proportions are different, and specifically, the tabs 116 are longer than the tabs 32 of the baffle-tile 14.

The three-dimensional configuration of the baffle-tile 100 is shown in FIG. 7. In this configuration, the tabs 116 abut one another, extending upwardly. The central area 106 extends downwardly, forming a baffle. However, because of the proportions of the baffle-tile 100 and its tabs 116, the central area 106 does not reach the same position as the comparable structure in the baffle-tile 14 described above. Instead, as shown, the two flaps 120 that comprise the central section 106 form a V or triangle, with the point of the triangle made by the first fold line 102. As those of skill in the art will understand, the angle made by the two flaps 120 of the central section 106 will vary depending on the lengths of the tabs 116 and may be adjusted to steeper or shallower angles.

The configuration of the baffle-tile 100 shown in FIG. 7 may have advantages when installed. While not intending to be bound by any particular theory, sound waves may be scattered or attenuated when they move from one medium into another. Because the triangular baffle 106 has two pieces of tile material with an air gap in between them, it may help to attenuate sound. The increased complexity of the shape may have some use in that regard as well.

As with the baffle-tile 14 described above, forces exerted by a grid 10 may be sufficient to retain the baffle-tile 100 in the three-dimensional configuration shown in FIG. 7. If those forces are insufficient, the tabs 116 can be adhered together using adhesive tabs or fasteners.

Figure 8:
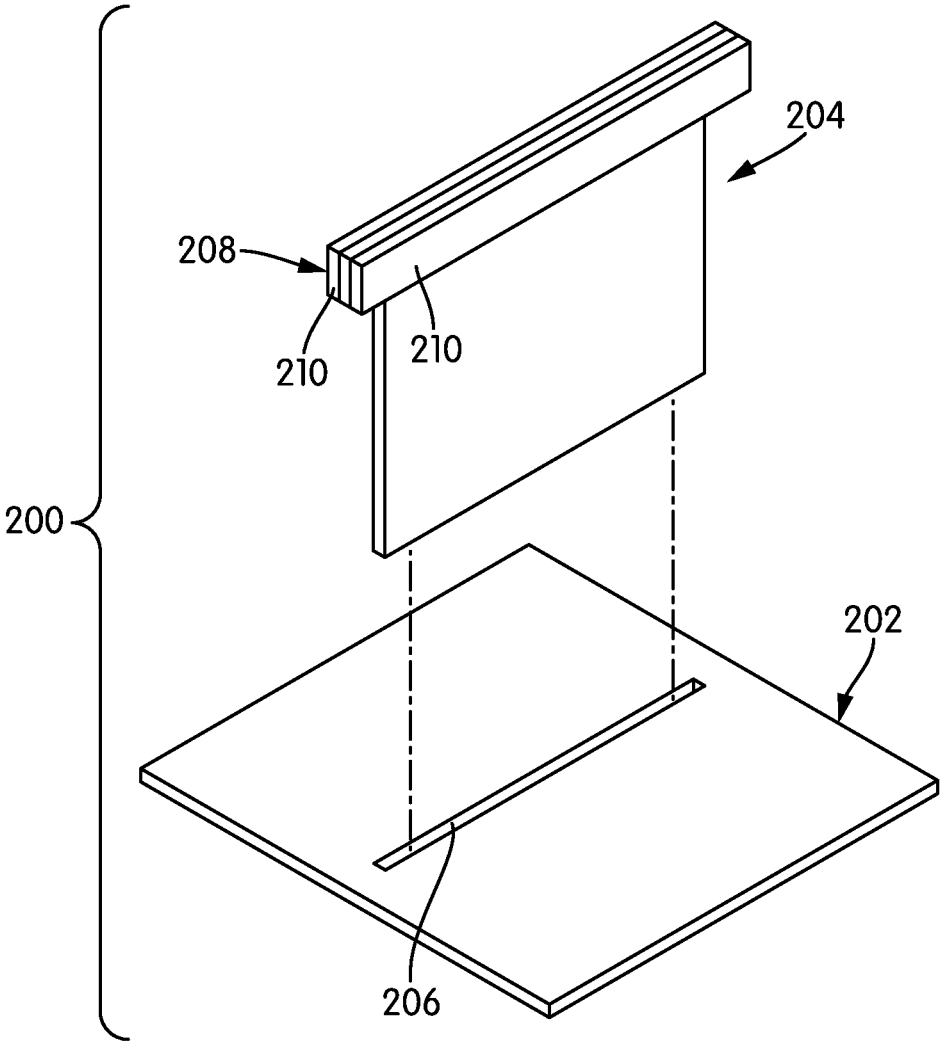
FIG. 8 is an exploded perspective view of a two-piece baffle-tile according to yet another embodiment of the invention.

In the two embodiments described above, the baffle-tile 14, 100 is a single-piece element that is folded into its final three-dimensional configuration. However, baffle-tiles according to embodiments of the invention need not be single-piece elements. As an example of a multiple-piece baffle tile, FIG. 8 illustrates a two-piece baffle-tile, generally indicated at 200. The two-piece baffle-tile 200 includes a tile 202 and a baffle 204. The tile 202 in this embodiment has a two-foot by two-foot square shape. A slot 206 is formed in the center of the tile 202 and extends much of the width of the tile 202.

In the illustrated embodiment, the slot 206 is a simple slot created in the tile 202 with a cutter, router, end mill, or other such cutting tool. The slot 206 is bare in the illustrated embodiment, simply a cut-out in the surrounding tile material. However, in some cases, the edges of the slot 206 could be reinforced.

The baffle 204 inserts into the slot 206. The baffle 204 is comprised of a single thickness of tile material 205 with a flange 208 along its upper edge. The flange 208 of this embodiment comprises two thicknesses 210 of tile material. If the tile material has a thickness of 9 mm, the flange 208 would have a total thickness of about 27 mm. As shown in the cross-sectional view of FIG. 9, the flange 208 keeps the baffle 204 from falling through the slot 206. The flange 208 extends past the edges of the slot 206, serving as a beam that, in some cases, may be directly supported by the grid 10. However, in other embodiments, the flange 208 may not extend across the entire tile 200. More generally, the flange 208 is larger than the slot 206 in at least one dimension.

In the illustrated embodiment, the baffle 204 hangs straight down, aligned with vertical. There is no requirement that this be the case. For example, the slot 206 could be formed on an angle, which would cause the baffle 204 to hang at an angle. There is also no requirement that each tile 200 have only one slot 206; in other embodiments, the tile 200 could have several slots 206, each set to house one baffle 204.

Figure 9:
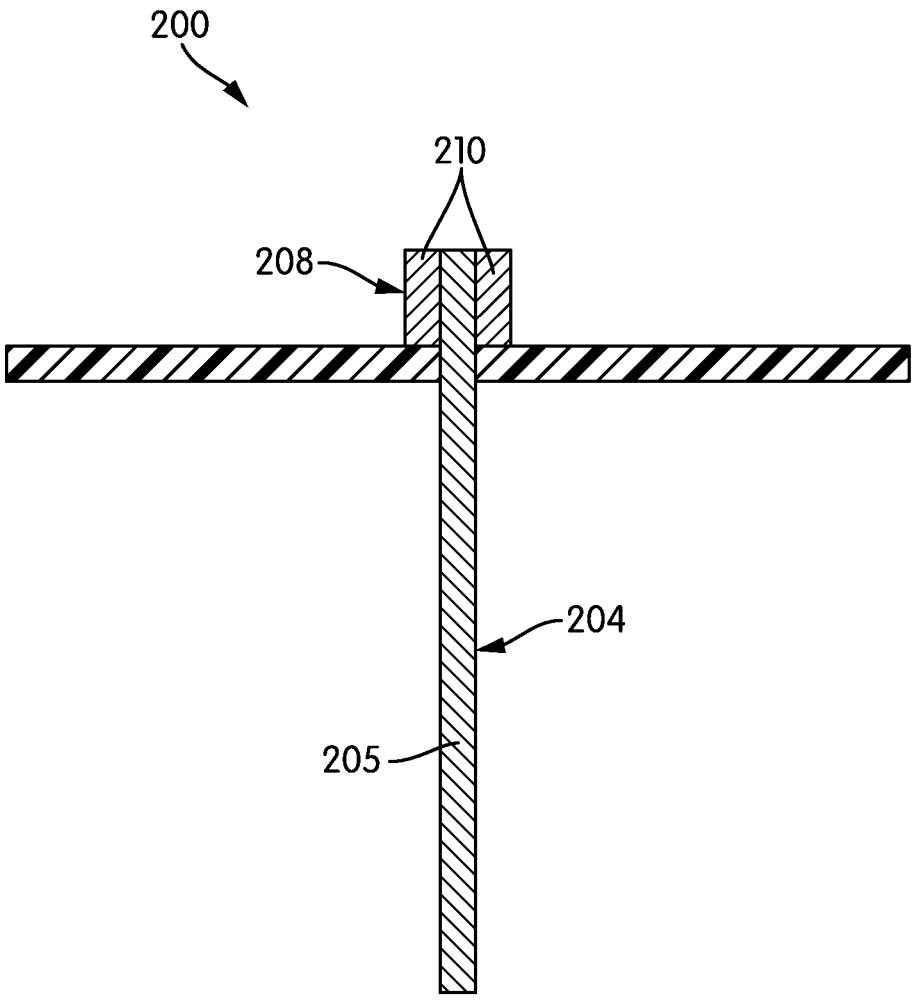
FIG. 9 is a cross-sectional view of the two-piece baffle-tile of FIG. 8.

One advantage of a two-part baffle-tile like the baffle-tile 200 of FIGS. 8-9 is greater versatility. First, because the baffle 204 is free-hanging, it can be cut into various decorative shapes or otherwise modified for decorative or aesthetic effect. Of course, this is possible with the baffle-tiles 14, 100 described above, but to a more limited extent. The length of the baffle 204 is also basically arbitrary, and the baffle 204 may be longer than the baffle 16, 106 of a folding baffle-tile 14, 100. Additionally, the baffle 204 need not be made of the same material as the tile 202, although it is certainly convenient if the baffle 204 and tile are made of the same material. In addition to the aesthetic possibilities presented by different materials, materials with different masses and densities may contribute to noise attenuation.

Figure 10:
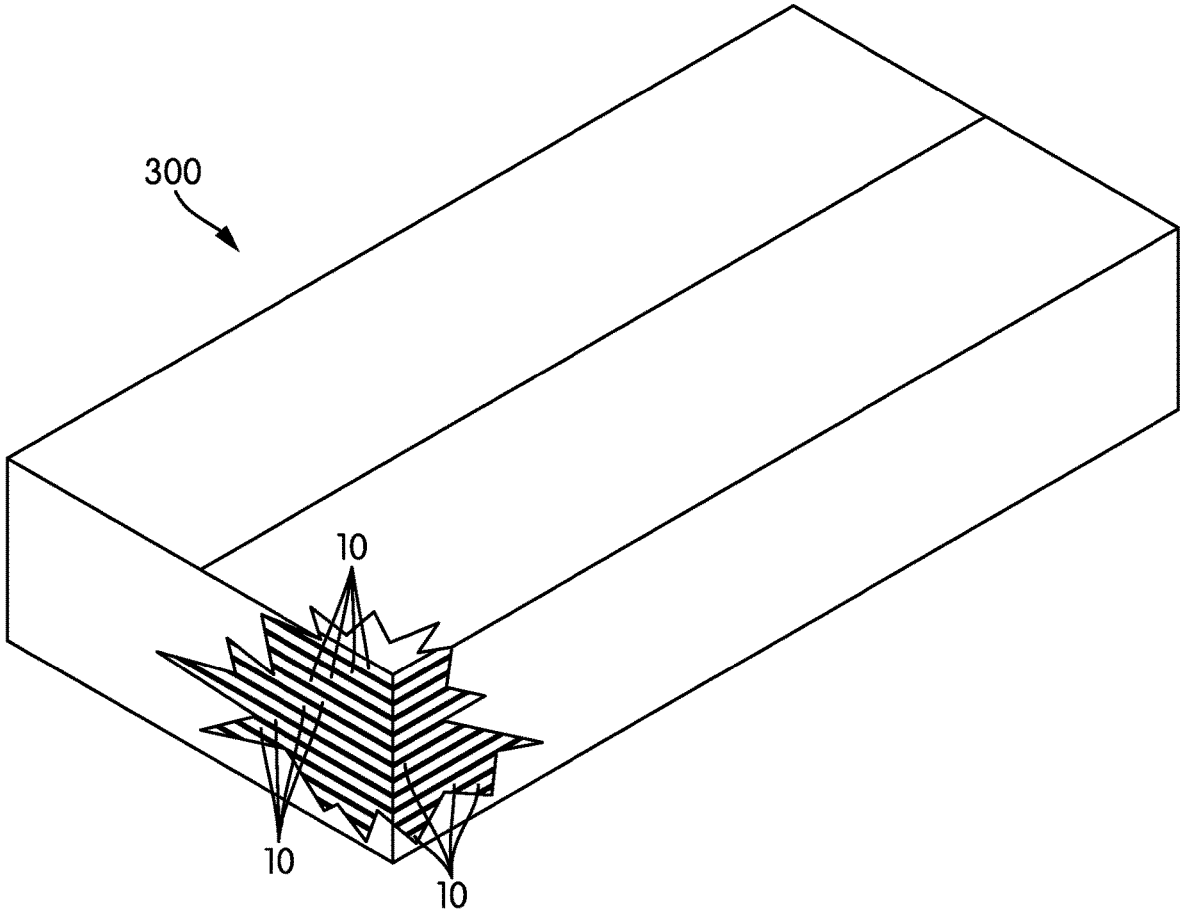
FIG. 10 is a perspective view of a shipping box with a number of ceiling tiles according to embodiments of the invention flat-packed within the box.

As was noted briefly above, baffle-tiles 10, 100, 200 in their three-dimensional forms consume a lot of space. For that reason, the baffle-tiles 10, 100, 200 disclosed here preferably are manufactured so that they can be shipped and handled flat and folded into their three-dimensional configurations as close to the point of installation as possible. However, beyond consuming less space in shipping, there are myriad advantages to this. For one, it is easier to manipulate flat baffle-tiles 10, 100, 200 on and close to the job site. A number of baffle-tiles 14 flat-packed in a box 300, as shown in the perspective view of FIG. 10, can easily be brought onto standard elevators and moved to the point of installation without any special considerations. The box 300 shown in FIG. 10 is a rectangular prism; however, in some situations, the baffle-tiles 14 could be folded to fit in, e.g., a two-foot by two-foot cubic box.

Thus, with flat-packed baffle-tiles 10, 100, 200 it is not necessary to plan for the installation of the baffle-tiles 10, 100, 200 early in construction. This also means that baffle-tiles 10, 100, 200 can be retrofit to an existing drop ceiling without any special effort. It may not even be necessary to secure a freight elevator to move the baffle-tiles 10, 100, 200. This provides considerable advantages during construction and installation.

Figure 11:
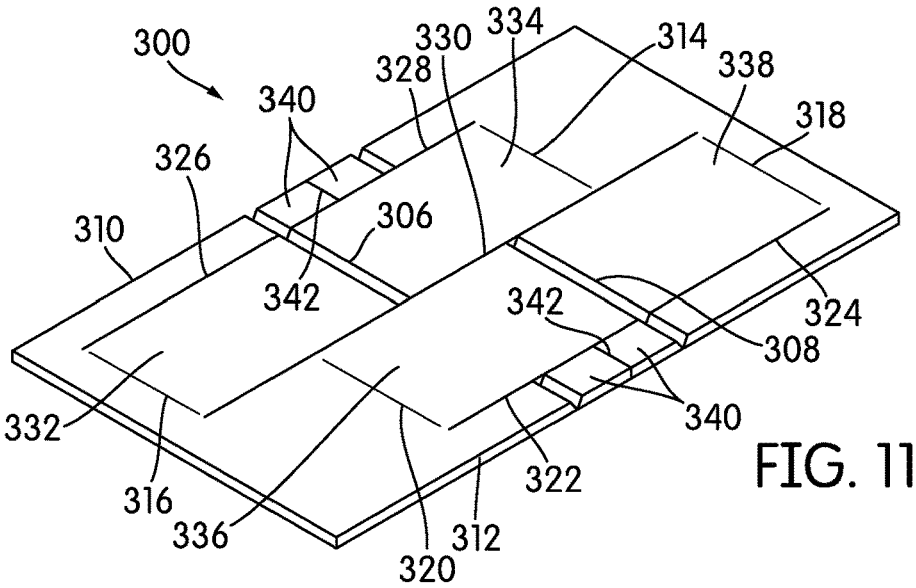
FIGS. 11-13 are perspective views of a baffle-tile according to another embodiment of the invention, illustrating its folding sequence from a flat configuration into a three-dimensional configuration.
Figure 12:
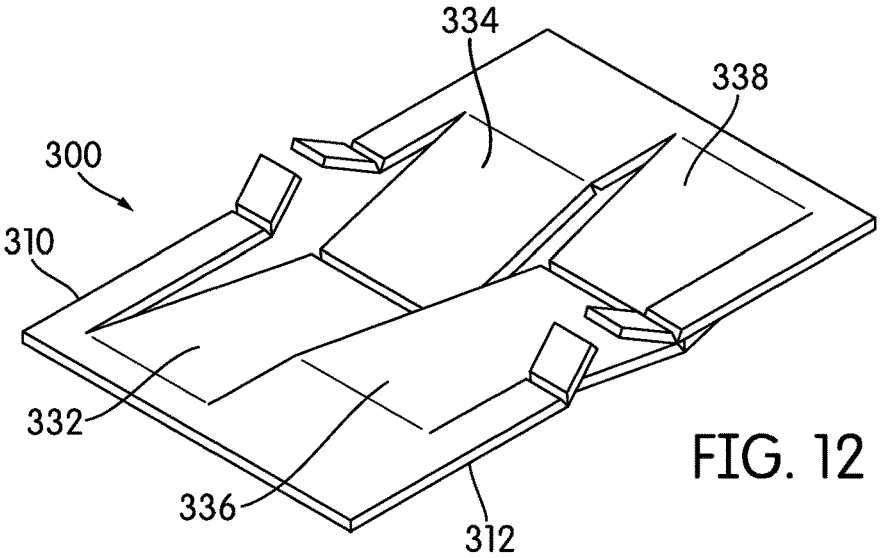
Figure 13:
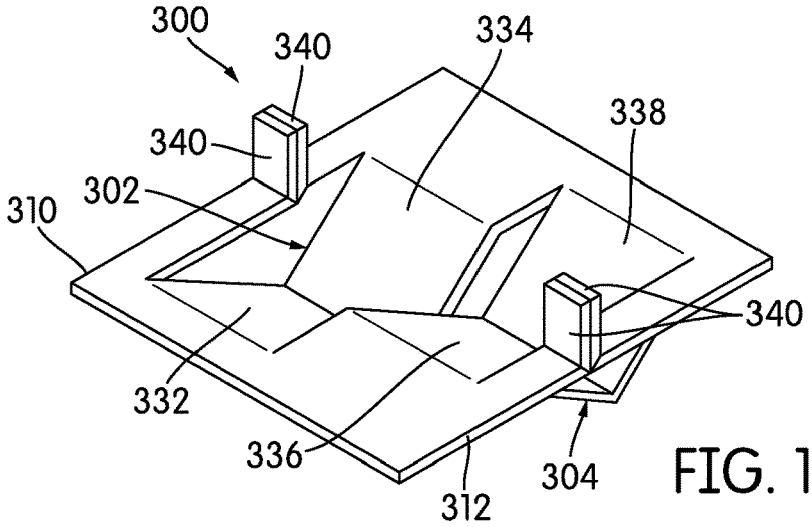

FIGS. 11-13 are perspective views of a baffle-tile, generally indicated at 300, according to another embodiment of the invention. Specifically, FIGS. 11-13 illustrate a folding sequence for the baffle-tile 300. With the folding baffle-tiles 10, 100 described above, there is a single baffle 16, 106, defined in part by a single fold line 26, 102 that traverses the majority of the transverse centerline of the baffle-tile 10, 100. That need not be the case in all embodiments; a baffle-tile according to embodiments of the invention may have more than one baffle in a single tile.

FIG. 13 shows the final, folded configuration of the baffle-tile 300. As shown in FIG. 13, the baffle-tile 300 has two baffles 302, 304, staggered in position along the tile. In this embodiment, each of the two baffles 302, 304 has a V-shape, although the baffles 302, 304 could be shaped or proportioned differently.

As with the baffle-tiles 10, 100 described above, the baffle-tile 300 is initially a flat sheet of tile material with cuts, fold lines, and break lines that allow the baffle-tile 300 to be folded into the three-dimensional configuration shown in FIG. 13. Specifically, as shown in FIG. 11, there are two V-cut first fold lines 306, 308, each extending from one of the long sides 310, 312 to the longitudinal centerline of the baffle-tile 300. These first fold lines 306, 308 are offset from one another such that they do not intersect one another and extend on either side of the transverse centerline of the baffle-tile 300. The first fold lines 306, 308 form the respective central fold lines of the two individual baffles 302, 304.

Each first fold line 306, 308 has its own pair of second fold lines 314, 316, 318, 320. The second fold lines 314, 316, 318, 320 extend parallel to their respective first fold lines 306, 308 and are spaced from the first fold lines 306, 308 along the longitudinal axis of the baffle-tile 300. In the illustrated embodiment, each pair of second fold lines 314, 316, 318, 320 is symmetrical about its first fold line 306, 308, meaning that each second fold line 314, 316, 318, 320 is the same distance from its first fold line 306, 308. That need not be the case in all embodiments.

Break lines 322, 324, 326, 328, 330 extend longitudinally to either side of the first fold lines 306, 308 to define rectangular panels 332, 334, 336, 338 that fold down about the first fold lines 306, 308, as shown in FIG. 12, out of the original plane of the baffle-tile 300. In the baffle-tile 300, the resulting baffles 302, 304 are identical, although offset from one another in position. However, the baffles 302, 304 need not be identical in other embodiments.

The baffle-tile 300 shares the shape characteristics of the baffle-tiles 10, 100 described above: it is rectangular in its initial configuration and square in its final, folded configuration, meaning that it can be shipped flat, e.g., in a 2×4 size and folded to fit into a 2×2 grid.

The baffle-tile 300 also has tabs 340 which fold up and abut each other in the final, folded configuration of FIG. 13. Short transverse break lines 342 aligned with the transverse centerline of the baffle-tile 300 define the free edges of the tabs 340. On their connected edges, the tabs 340 fold upward about the first fold lines 306, 308. As was described above, if the lateral forces of the grid on the baffle-tiles 300 are not enough to maintain them in their folded configurations, then the tabs 340 may be secured together with adhesive, fasteners, clips, or some other means in order to hold the baffle-tile 300 in its folded configuration.

As was noted briefly above, and as was shown and described above with respect to other embodiments, the proportions of the baffle-tile 300 could be altered so that the two baffles 302, 304 are doubled layers of tile material that abut one another and extend vertically downwardly.

In the figures, certain fold lines 28, 108, 332, 334, 336, 338 are shown or described as being V-cuts that are made on the bottom of the sheet of tile material. This need not be the case in all embodiments. When a fold line is made by cutting the tile material, that cut may be made in either the top or the bottom surface of the tile material. For convenience and ease in manufacturing, it may be more convenient to make all cuts on a single surface of the tile material, like the top surface, to the extent possible.

While the invention has been described with respect to certain embodiments, the description is intended to be exemplary, rather than limiting. Modifications and changes may be made within the scope of the invention, which is defined by the appended claims.

What is claimed is:

1. A ceiling tile, comprising:

a main portion comprised of a sheet of material and having a slot therein, the slot having a constant width; and a baffle portion that inserts into the slot such that with the ceiling tile in an installed orientation, the baffle portion extends downwardly from the main portion, the baffle portion having a flange on one end, the flange being larger in width and length than the slot, such that the flange retains the baffle portion in the slot.

2. The ceiling tile of claim 1, wherein the flange comprises one or more sections of tile material attached to the end of the baffle portion.

3. The ceiling tile of claim 1, wherein the main portion and the baffle portion are separable from one another.

4. The ceiling tile of claim 1, wherein the main portion extends horizontally in the installed orientation.

5. The ceiling tile of claim 1, wherein the sheet of material of which the main portion is comprised is a sheet of tile material.

6. The ceiling tile of claim 5, wherein the sheet of tile material comprises a sheet of PET felt.

7. The ceiling tile of claim 6, wherein the flange of the baffle portion comprises additional pieces of material secured to the sheet of tile material.

8. The ceiling tile of claim 7, wherein the additional pieces of material are additional pieces of tile material.

9. The ceiling tile of claim 8, wherein the sheet of tile material and the additional pieces of tile material comprise the same material.

10. The ceiling tile of claim 1, wherein the baffle portion is made of a different material than the main portion.

11. The ceiling tile of claim 1, wherein the slot in the main portion is positioned and dimensioned such that it is surrounded by the sheet of material on all sides, forming a closed slot.

12. The ceiling tile of claim 1, wherein the flange of the baffle portion is longer than the slot.

13. The ceiling tile of claim 12, wherein the flange of the baffle portion extends to at least one side edge of the main portion.

14. A ceiling tile, comprising:

a main portion comprised of a sheet of material and having a slot therein, the slot having a constant width and being positioned and dimensioned within the sheet of material such that the slot is closed on all sides; and a baffle portion that inserts into the slot such that with the ceiling tile in an installed orientation, the baffle portion extends downwardly from the main portion, the baffle portion having a flange on one end, the flange being larger in width or length than the slot, such that the flange retains the baffle portion in the slot.

15. The ceiling tile of claim 14, wherein the flange of the baffle portion is wider than the slot.

16. The ceiling tile of claim 15, wherein the baffle portion comprises layers of additional material secured to the flange of the baffle portion so as to be wider than the slot.

17. The ceiling tile of claim 14, wherein the flange of the baffle portion is longer than the slot.

18. The ceiling tile of claim 17, wherein the flange of the baffle portion extends to opposite side edges of the main portion.

19. The ceiling tile of claim 14, wherein the main portion and the baffle portion are comprised of sheets of tile material.

20. A drop ceiling, comprising:

a grid adapted to be suspended from a ceiling; and one or more tiles adapted to fit within the grid to form the drop ceiling, each of the one or more tiles including a main portion comprised of a sheet of material adapted to fit within the grid and having a slot therein, the slot having a constant width and being positioned and dimensioned within the sheet of material such that the slot is closed on all sides, and a baffle portion that inserts into the slot such that with the ceiling tile in an installed orientation, the baffle portion extends downwardly from the main portion, the baffle portion having a flange on one end, the flange being larger in width or length than the slot, such that the flange retains the baffle portion in the slot.

* * * * *